US005159914A

United States Patent [19]

Follmer et al.

[11] Patent Number: 5,159,914

[45] Date of Patent: Nov. 3, 1992

[54] DYNAMIC FUEL CONTROL

[75] Inventors: William C. Follmer, Livonia; Jeffry A. Greenberg, Ann Arbor; Isis A. Messih, Troy, all of Mich.

[73] Assignee: Ford Motor Company, Dearborn, Mich.

[21] Appl. No.: 786,494

[22] Filed: Nov. 1, 1991

[51] Int. Cl.[5] ..... F02D 41/04

[52] U.S. Cl. ..... 123/494; 123/478; 123/488

[58] Field of Search ..... 123/478, 480, 488, 494; 73/118.2; 364/431.05, 431.07, 510

[56] References Cited

U.S. PATENT DOCUMENTS 4,548,185 10/1985 Pozniak ..... 123/478 X
4,630,206 12/1986 Amamo et al. ..... 364/431.07
4,721,087 1/1988 Kanno et al. ..... 123/488
4,785,784 11/1988 Nanyoshi et al. ..... 123/478
4,792,905 12/1988 Sekozawa et al. ..... 123/478 X
4,860,222 8/1989 Schmidt et al. ..... 123/478 X
4,911,133 3/1990 Sogawa ..... 123/494
4,955,339 9/1990 Sasaki et al. ..... 123/478 X
4,958,516 9/1990 Stiles et al. ..... 123/478 X
4,961,411 10/1990 Oshiage et al. ..... 123/478 X
4,967,711 11/1990 Morikawa ..... 123/478
5,068,794 11/1991 Hosaka ..... 123/478 X
5,094,213 3/1992 Dudek et al. ..... 123/478

*Primary Examiner*—Willis R. Wolfe
*Attorney, Agent, or Firm*—Peter Abolins; Roger L. May

[57] ABSTRACT

Air/fuel ratio of an internal combustion engine is controlled by predicting the air charge to enter the engine two cylinder events into the future and then determining the amount of fuel to be injected to achieve a desired air/fuel ratio. A first fuel pulse is injected, and if needed, a second fuel pulse is injected to achieve the needed amount of fuel for the desired air/fuel ratio.

7 Claims, 7 Drawing Sheets

ENGINE RESPONSE AND A/F PRIOR TO DYNAMIC FUEL CONTROL

ENGINE RESPONSE AND A/F AFTER DYNAMIC FUEL CONTROL

ENGINE RESPONSE & INJECTOR PULSES BEFORE DYNAMIC FUEL CONTROL

ENGINE RESPONSE & INJECTOR PULSES AFTER DYNAMIC FUEL CONTROL

DYNAMIC FUEL CONTROL

BACKGROUND OF THE INVENTION

1. Field of the Invention

The present invention relates generally to a fuel injection system for internal combustion engines such as used in automotive vehicles and, more particularly, to a fuel injection control method and device for controlling the air/fuel mixture introduced into an engine.

2. Prior Art

Fuel injection systems employing airflow meters have been used in various kinds of automotive engines In a typical system of known type, the airflow meter is installed in the air intake system at an upstream position of the throttle valve to detect accurately the flow rate Q of the air induced into the engine. Then the basic fuel injection quantity Tp, corresponding to the fuel injection duration, is such as to provide a fuel quantity corresponding to the induced airflow rate Q. For example, the basic fuel injection quantity Tp which is close to the theoretical (ideal) air/fuel ratio A/F is calculated in the formula of Tp approximately equals Q/N where N is the engine speed. The fuel injector is basically controlled on the basis of Tp.

A high degree of accuracy is required in the measurement of the engine induced airflow rate Q. Accordingly, precise means such as airflow meters of the hot wire type possessing high accuracy response are used.

Sequential electronic fuel injection systems utilize mass flow measurement to determine air charge (Ma). The air charge calculations are completed at the end of an induction event, at the PIP up-edge interrupt, to provide for an average air charge for that event. A required fuel charge (Mf) is then computed using the desired air to fuel ratio (air/fuel). To provide the best combustion, the resulting fuel charge is injected on a closed intake valve. This is especially important at idle and for engines with low swirl and turbulence.

In today's typical sequential electronic fuel injection (SEFI)/mass air meter control system, the following sequence of events take place in the strategy.

1. First, airflow is measured by a meter mounted up-stream of the throttle body. The manipulation of the raw air meter signal is critical in order to provide a true indication of cylinder air charge.

2. Next, cylinder air charge at the port is determined using a physically based manifold filling model which takes into account parameters such as engine displacement, manifold volume and volumetric efficiency.

3. Once the true cylinder air charge is calculated the corresponding desired fuel charge is then computed:

FUEL-CHARGE(lbs)=CYLINDER-AIR-CHARGE / AIR-FUEL-RATIO

The determination of the desired AIR-FUEL-RATIO is complex and requires information from additional sensors, such as temperature, throttle position and exhaust gas oxygen (EGO) sensors as well as sophisticated control algorithms including adaptive fuel control.

4. The required fuel injector pulse width to deliver the desired fuel charge is then calculated, taking into consideration the injector flow rate and offset characteristics.

5. Next, the correct injection timing with respect to the intake valve opening is calculated.

6. Finally, software schedules the injector to deliver the correct pulse width at the required timing.

During steady-state operation, the above calculations are straight forward. However, during transient conditions, accurate and timely fuel control is much more difficult to achieve.

A challenge for the fuel delivery system comes under transient conditions when the throttle is either opened or closed rapidly. Under these conditions, airflow into the cylinder changes very quickly from one cylinder induction event to the next. The ability to cope with these rapid changes is not only determined by the control system hardware, but also by the sophistication of the control strategy.

FIG. 1 depicts what happens with a conventional SEFI/Mass Air Control System when the throttle is rapidly opened and closed at a rate of 500 angular degrees per second. Upon a rapid throttle opening using conventional control strategy approaches, the inherent computational delays result in several consecutive induction events having inadequate fuel delivery, leading to misfire and poor combustion. These characteristics are exhibited by a drop in IMEP (Indicated Mean Effective Pressure) to zero, an increase in air/fuel to above 20:1 and an engine speed drop of 100 RPM. This situation results in a perceived hesitation by the driver, a hydrocarbon spike and a thermal shock to the catalyst which could lead to premature deactivation.

U.S. Pat. No. 4,630,206 discloses a fuel injection system based on computed mass air using an airflow meter. The system compensates for the air charge "calculation delay" problem through multiplying the air quantity obtained in the immediately preceding intake stroke by a ratio of the instantaneous intake airflow rate sampled at a referenced timing in the preceding intake stroke and the instantaneous airflow rate at a referenced timing in the present intake stroke.

With reference to FIG. 6 of '206, air charge $Q_1$ (throttle not cylinder) is obtained by integrating the instantaneous airflow rates $q_1$–$q_5$. $Q_1$ is used to compute $Q_2$, the air charge of the next intake stroke, by multiplying $Q_1$ by the ratio $q_6/q_1$ as seen in equation 4 at column 7. Thus, under a mildly accelerating condition as shown in FIG. 6, the fuel valve opening period is slightly greater at $t_2$ than at $t_1$.

A different scheme is used to predict fuel amount under high acceleration, as shown in FIG. 8 of '206, in which additional fuel pulses, e.g., $t_{22}$, $t_{23}$, are supplied to the engine. To determine whether additional fuel pulses are needed, the system first decides whether the engine is under acceleration as indicated by a throttle sensor or other means (see column 11, lines 52–60). If so, additional fuel is injected based on the computed difference between instantaneous airflow rates in the same intake stroke cycle.

The '206 patent does not calculate cylinder air charge based on a manifold filling model. Instead, it teaches computing the ratio between the instantaneous intake airflow rate sampled at a referenced timing in the preceding intake stroke and that sampled at a referenced timing in the present intake stroke.

U.S Pat. No. 4,911,133 is directed to a fuel injection system which estimates the quantity of air within an intake system downstream of a throttle valve using a model of air within the intake pipe. The patent teaches inferring cylinder air charge based on the total air weight of induced air in the intake system.

U.S. Pat. No. 4,721,087 is directed to a fuel control apparatus which estimates cylinder air charge based on the equation:

$$Qe(n)=KQe(n-1)+(1-K)Qa,$$

where Qe(n) represents cylinder air charge in the present engine cycle, Qe(n−1) is cylinder air charge in the preceding cycle and Qa is air charge from the throttle flow as measured by the airflow sensor.

U.S. Pat. No. 4,721,087 also teaches a fuel control apparatus with an AN detecting means which detects the output of said airflow sensor at a predetermined crank angle of said internal combustion engine thereby to detect a ratio of said output to the number of revolutions of said internal combustion engine. In an AN detecting means an airflow is represented by A and the engine speed by N so that AN is a ratio of air intake quantity to the number of revolutions of the engine.

Applicants' invention includes predicting air charge two cylinder events into the future. With respect to U.S. Pat. No. '087, Applicants' prediction of air charge takes into account the effect of engine load on volumetric efficiency of the engine in a continuous way. That is, the parameter, k, changes over the entire operating range of the engine. In Applicants' invention all calculations are based on airflow, not on throttle position and/or rate of change of throttle position.

U.S. Pat. 4,911,133 teaches calculating the mass of air in an intake system. In contrast, Applicants' invention calculates only the air mass in the currently filling cylinder.

It would be desirable to further improve the calculation of the amount of fuel needed at a given engine operating condition and to alter the timing of fuel injection into the engine. These are some of the problems this invention overcomes.

SUMMARY OF THE INVENTION

This invention includes the use of an air meter signal and a manifold filling model to determine the optimum fuel charge required when an engine cylinder is at a maximum airflow. Additionally, the invention can predict the air charge to enter the engine two cylinder events in the future and provides for injection of a second fuel pulse if needed for a particular cylinder. This results in tighter air/fuel ratio control and improved tip in response. When the driver opens the throttle more, or tips in, there is an improved response of the car to driver's desires. The requirements for integrating the air charge over an induction event and for closed valve fuel delivery produces a mandatory delay of at least two induction events.

Applicants' invention uses two cylinder events in the future because the time between when you decide to put out a fuel injection pulse and the time when the fuel is inducted into the cylinder takes at least two cylinder events. That is, the first event is an event delay reading the air meter signal over an induction cycle. The second event delay is the need to inject on a closed intake valve into the cylinder.

In accordance with Applicants' invention there are either one or two fuel injections. The second fuel injection pulse always occurs at a predetermined point in the intake stroke. For example, in eight and four cylinder engines the second fuel injection takes place when the piston is positioned one-half of the way down the cylinder during the intact stroke. There is a practical consideration that the fuel injector needs a certain minimum fuel injection pulse width because of nonlinearities.

As can be seen on FIG. 2, by changing the control strategy to incorporate an embodiment of this invention for dynamic fuel control, significant improvements are achieved. Under the same 500 angular degree per second opening rate no misfires were encountered, the air/fuel excursion remained below the lean misfire limit and no engine speed drop was encountered.

Such a dynamic fuel control strategy provides accurate and timely fuel control under transient conditions resulting in the following benefits:

1. Improved driveability over a wide range of driving conditions by preventing lean misfires during accelerations and reducing air/fuel ratio excursions during decelerations.

2. Significant improvement in emissions as a result of the tighter air/fuel ratio control.

3. A cost reduction is achieved by either eliminating the hardware TAR (Throttle Angle Rate) circuit or saving 400 bytes of memory by eliminating the software TAR calculations. This is achievable because the algorithms applied use only the air meter information to determine the best fuel charge required. This eliminates the need for throttle rate information.

4. A simplified transient fuel calibration process is achieved since: (a) calibration parameters are reduced from over 130 items down to two; these two items reflect the unique, physically measurable, characteristics (e.g., lean misfire limit) of the particular system under development; (b) calibration of convention strategy requires extensive development effort and testing since the calibration engineer has to determine the amount of additional fuel needed during acceleration based on many inputs such as throttle rate of change, engine coolant temperature (ECT), throttle position (TP) and barometric pressure (BP); the dynamic fuel control strategy uses the latest input information available and physically calculates the total fuel requirements needed to achieve the desired air/fuel ratio. The result is a robust system, insensitive to a development engineer's experience and calibration style.

BRIEF DESCRIPTION OF THE DRAWINGS

FIGS. 3 and 4 show the details of injector pulses, individual cylinder pressures PIP and the air meter signal during the tip in part of tests 1 and 2 respectively;

DETAILED DESCRIPTION OF THE INVENTION

Figure 1:
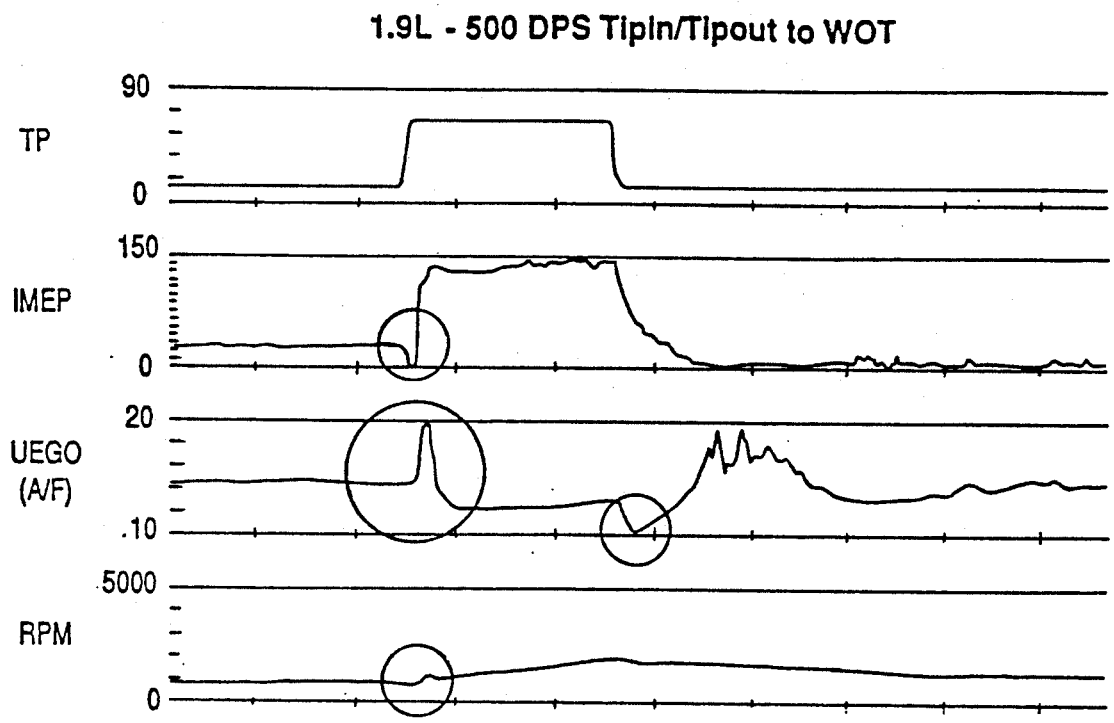
(PRIOR ART) FIG. 1
FIGS. 1–4 show sample of data taken on a 1.9 liter 4-cylinder engine, FIGS. 1 and 2 showing a tip in followed by a tip out with and without dynamic fuel control strategy.
Figure 2:
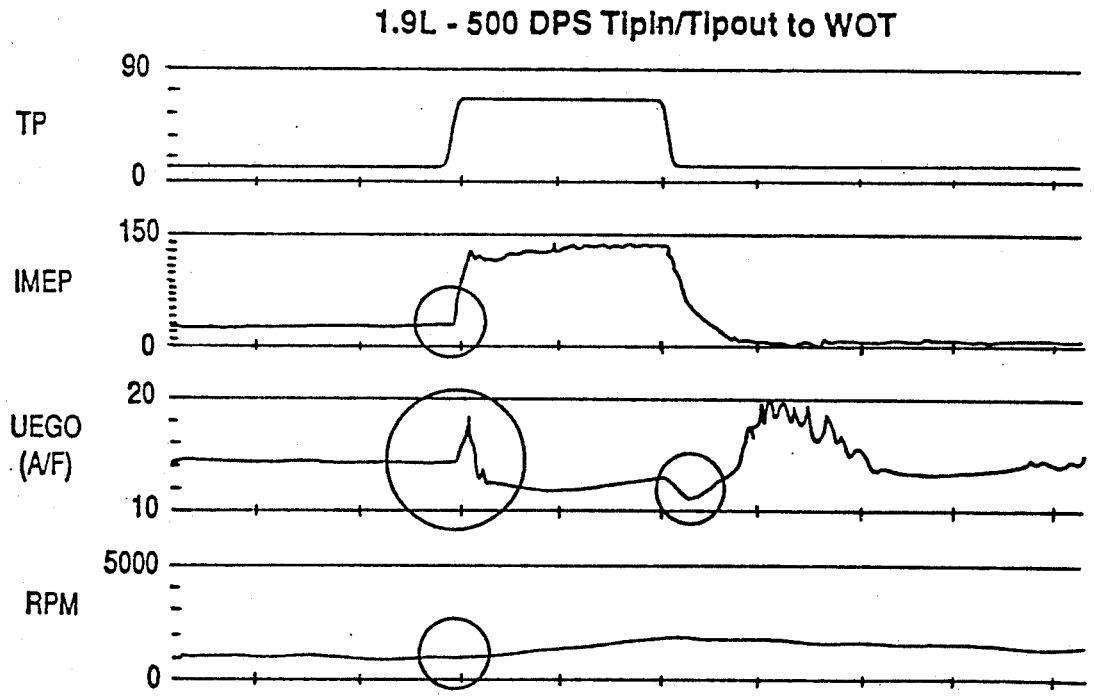
Figure 3:
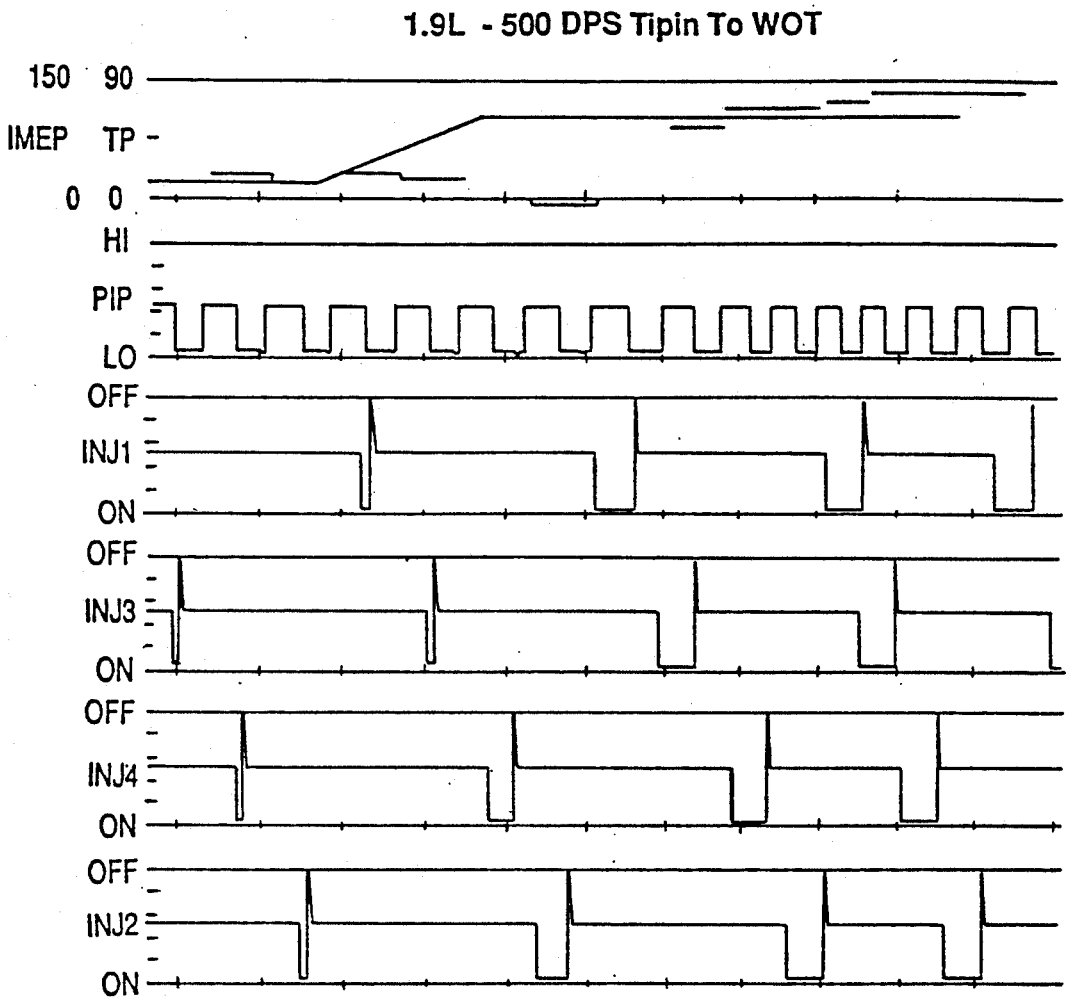
(PRIOR ART) FIG.3
Figure 4:
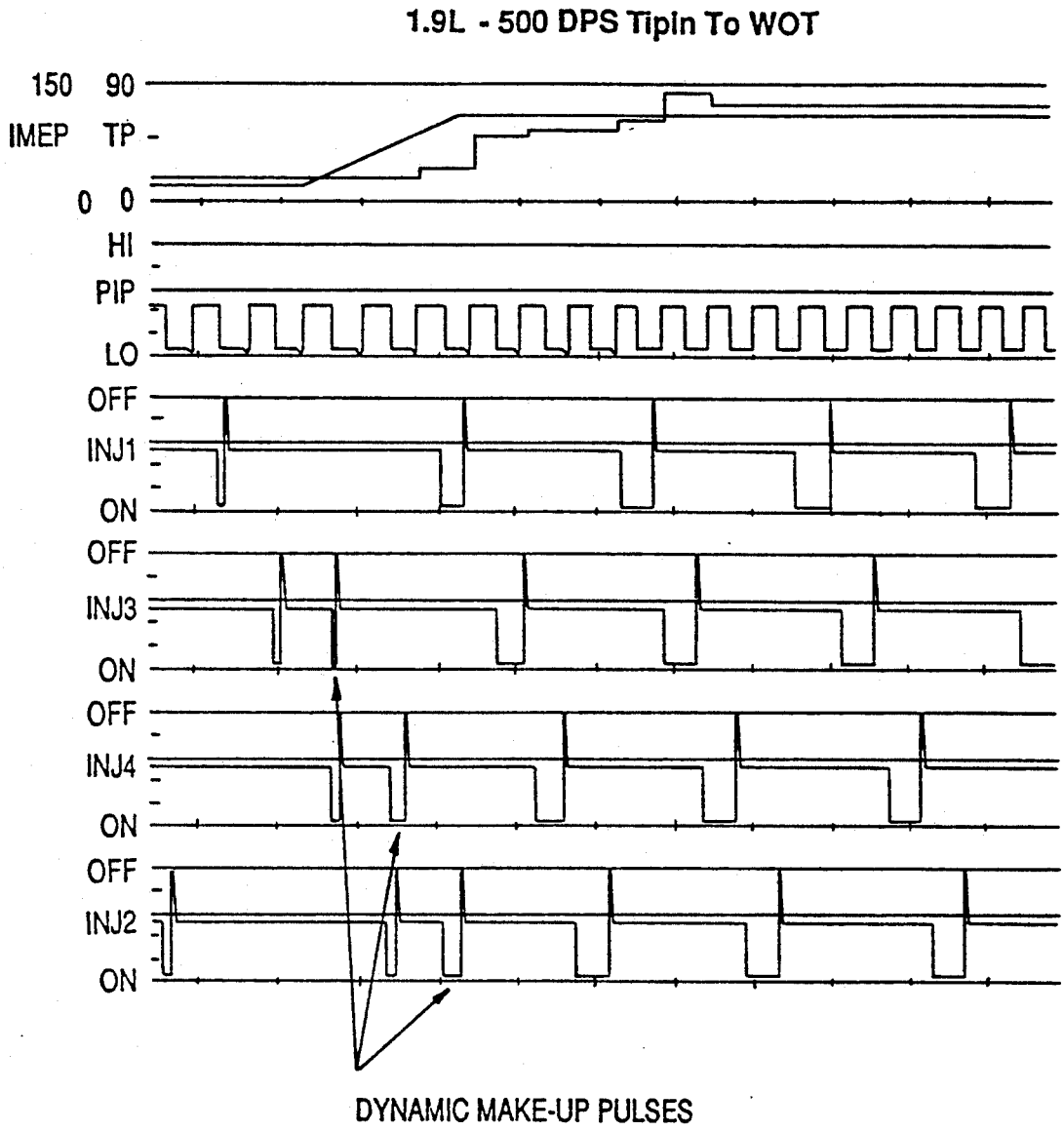

FIGS. 1–4 show a sample of data taken on 1.9L 4-cylinder engine. FIGS. 1 and 2 show a tipin to $\frac{3}{4}$ throttle at 500°/sec followed by a tipout two seconds later with and without dynamic fuel control strategy. Throttle position, IMEP, air/fuel and RPM are shown. FIGS. 3 and 4 show the details of the injector pulses, individual cylinder pressures, PIP and the air meter signal during the tipin part of tests 1 and 2 respectively.

The data shows that with the dynamic fuel control strategy, all lean misfires were eliminated for tipin rates of 500°/sec or less as indicated by the IMEP trace. An improvement of 0.5–1.0 in the average air/fuel ratio during the decels was observed on the UEGO.

In a mass air system, airflow is measured through a meter mounted upstream of the throttle body and cylinder air charge is inferred at the port using a manifold filling model of the form.

$$M_i^c = kM_i^{tb} + (1-k)\, M_{i-1}^c \qquad (1)$$

where $M^c$ = Cylinder air charge $M^{tb}$ = Air charge from throttle flow $$k = \left(\frac{1}{ncyl}\right)\left(\frac{Vd}{Vm}\right) \times N \times \eta_v$$

ncyl = Number of cylinders

N = Engine speed (RPM)

Vd = Engine displacement(cu.in.)

Vm = Manifold volume(cu.in.)

$\eta_v$ = Volumetric efficiency.

Figure 8:
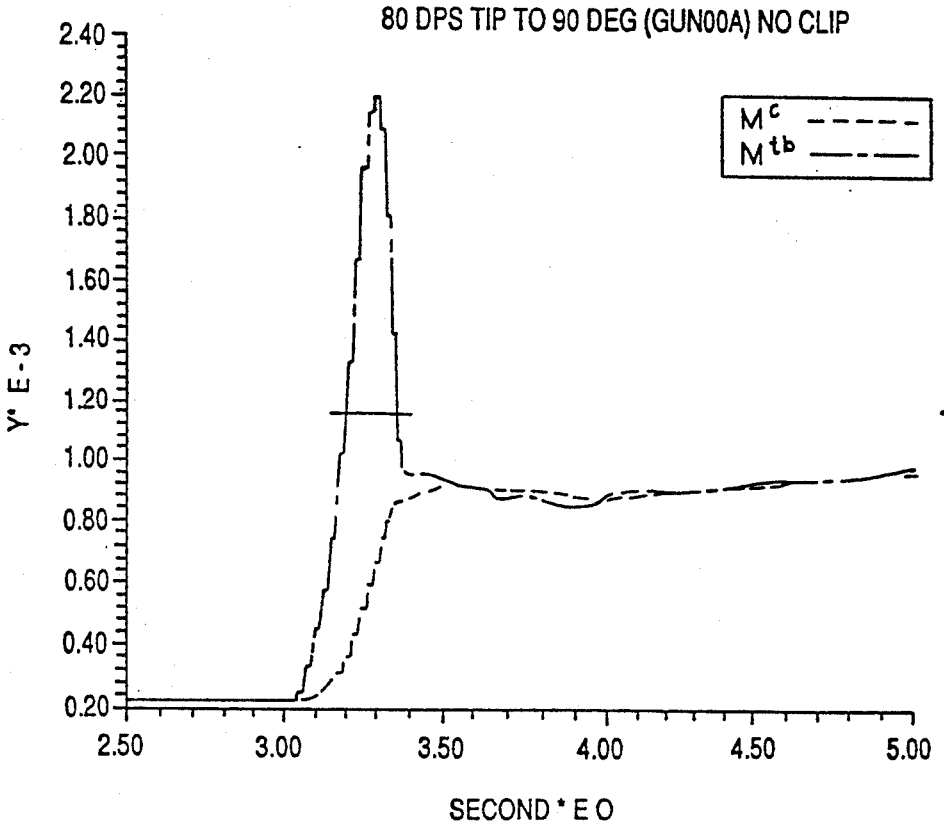
FIG. 8 is a graphical representation of air charge measured at the meter ($M^{tb}$), and air charge estimated at the cylinder ($M^c$) versus time during tipin.
Figure 9:
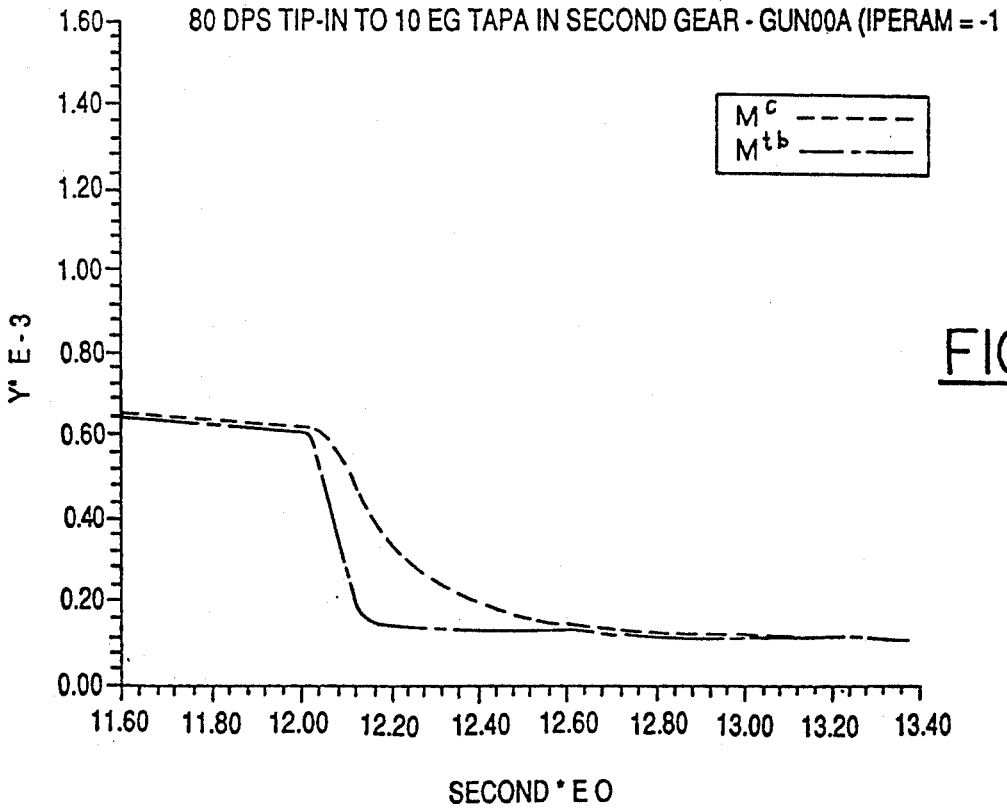
FIG. 9 is a graphical representation of $M^{tb}$ and $M^c$ versus time during tipout when the metered air charge falls quickly and engine air charge follows the intake manifold pressure and falls more slowly.

See FIGS. 8 and 9 for a graphical illustration of the operation of this invention. FIG. 8 illustrating throttle opening and FIG. 9 illustrating throttle closing. To reduce the effect of the delays mentioned in the problem statement of air/fuel excursions, a scheme to anticipate cylinder air charge two events in the future uses a recursion of the manifold filling model.

Rewriting equation (1) for events i+1 and i+2, yields, $$M_{i+1}^c = kM_{i+1}^{tb} + (1-k)\, M_i^c$$

$$M_{i+2}^c = kM_{i+2}^{tb} + (1-K)\, [kM_{i+1}^{tb} + (1-k)\, M_i^c] \qquad (2)$$

let $$M_{i+1}^{tb} = M_i^{tb} + (M_i^{tb} - M_{i-1}^{tb})$$

$$M_{i+2}^{tb} = M_{i+1}^{tb}$$

thus for event i+2, equation 2 can be written as:

$$M_{i+2}^c = (2-k)k\, [2M_i^{tb} - M_{i-1}^{tb}] + (1-k)^2 M_i^c$$

This anticipation scheme is effective in reducing the air/fuel excursions during decelerations and light tipins. However, during fast throttle movement, substantial change in air charge can occur over one induction event, thus producing a series of very lean mixture events. To improve the tipin transient response, an algorithm was developed which allows fuel to be delivered on an open intake valve under conditions when lean misfire is likely. This algorithm will be summarized below.

First, a record of the latest fuel charge computed and delivered to all cylinders is kept.

Next, the latest value of computed fuel charge, using the latest value of air charge available, is compared to the saved value corresponding to the cylinder that is now at maximum intake airflow (approximately 90° ATDC).

If the ratio of the latest fuel value to the previous fuel value for the cylinder at maximum airflow is greater than a preset threshold, then a second fuel pulse is scheduled to this cylinder to supply the quantity of fuel that corresponds to the difference in the two fuel values. If the ratio of fuel values is less than the threshold nothing further is done.

The value of the fuel ratio threshold is established by the operating air/fuel ratio and the lean air/fuel ratio the engine can be expected to tolerate. For most engines, operating at stoichiometric with a lean limit of 18 air/fuel ratio, the fuel ratio threshold is 18.0/14.6 or 1.2 approximately.

It should be noted that these algorithms eliminate the need for throttle rate of change information, simplify the acceleration enrichment strategy and calibration, and use only the air meter information to determine the best fuel charge required. The basic hardware components in accordance with an embodiment of this invention include a hot wire meter for measuring airflow, a microprocessor for executing the software manifold filling model, and a PIP (profile ignition pickup) sensor for providing timing/interrupt signals to the microprocessor to initiate airflow and fuel control calculations.

A manifold filling model estimates cylinder air charge, $M^c$, based on throttle airflow $M^{tb}$, as measured by the airflow meter. Once the cylinder air charge is determined, the fuel amount is computed using a desired air to fuel ratio. Thus, the subject system eliminates the need for throttle rate information and uses only the air meter information in conjunction with the model to determine the fuel charge.

Air charge calculations are delayed by at least two induction events due to the requirements for integrating the air charge and for delivering fuel on a closed valve. Because this calculation delay can cause potential engine problems when operating at other than steady running conditions, an anticipation scheme is used to estimate cylinder air charge two events in the future.

Even with anticipating cylinder air charge two events in the future, lean mixture combustion events occur under fast throttle movements such as during acceleration. To overcome this, the invention modifies the manifold filling model with the following algorithm for improving performance during fast throttle movements: 1) recording the latest fuel charge computed and delivered to all cylinders, 2) computing fuel charge using the latest value of air charge available, 3) comparing the computed fuel charge from 2 with the saved value from 1 corresponding to the cylinder that is now at maximum intake airflow, and 4) providing a second fuel pulse if the ratio of the latest fuel value to the previous fuel value from 3 is greater than a preset threshold.

Figure 5:
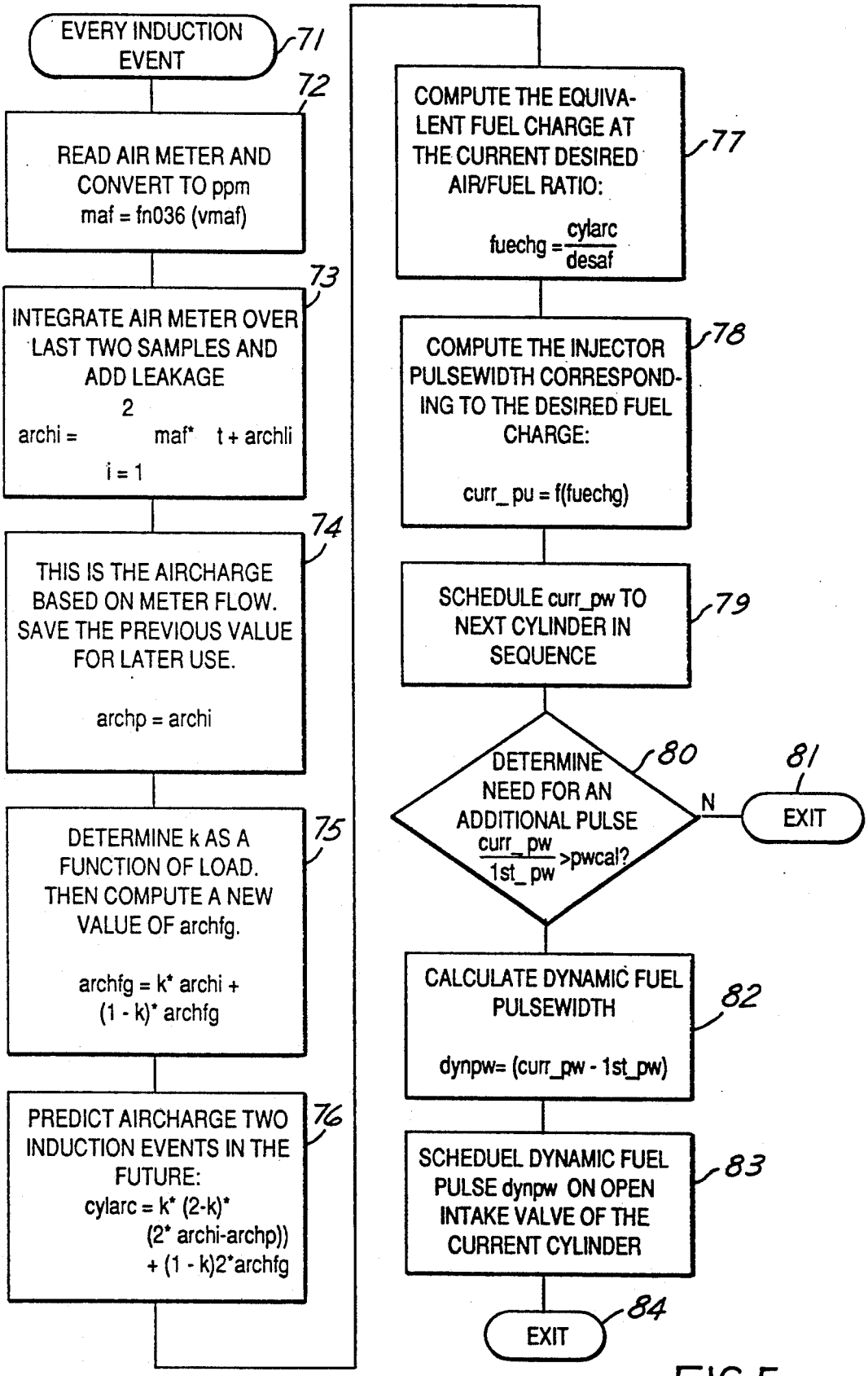
FIG. 5 is a logic flow diagram in accordance with an embodiment of this invention.

Referring to FIG. 5, a logic flow in accordance with this invention begins at a block 71 indicating the logic flow starts during every induction event. Logic flow goes to a block 72 wherein an air meter is read and a conversion is made to ppm. Logic flow then goes to a block 73 wherein the signal from the air meter is integrated over the last two samples and a term for air leakage is added. The term archi is used to indicate the air charge mass inducted per intake stroke corrected for back flow and leakage. This is equal to the equation:

$$archi = \sum_{i=1}^{2} maf \times \Delta t + archli.$$

wherein maf indicates mass air flow, Δt indicates an incremental time period, archli indicates an air flow leakage. Logic flow then goes to a block 74 wherein an air charge based on meter flow is determined. The previous value is saved for later use.

From block 74 logic flow proceeds successively to block 75, 76, 77, 78 and 79. In block 75, k is determined as a function of load and then there is computed a new value of archfg in accordance with the following equation: archfg=k*archi+(1−k)*archfg, wherein archfg is a predicted cylinder air charge from the manifold filling model. In block 76, there is predicted an air charge two induction events into the future using the following equation:

$$cylarc = k*(2-k)*(2*archi - archp)) + (1-k)2*archfg,$$

wherein archp is the air charge for the previous event. In block 77, the equivalent fuel charge is computed at the current desired air/fuel ratio using the following equation:

$$fuechg = \frac{cylarc}{desaf}$$

wherein, fuechg is fuel charge (lbm)

cylarc is air charge (lbm)

desaf is desired A/F ratio

In block 78, the injector pulse width is computed corresponding to the desired fuel charge using the following equation: curr_pw+f(fuechg). In block 79, the current pulse width is scheduled to the next cylinder in the sequence. This corresponds to the first fuel injection pulse in what may be a two fuel injection pulse sequence. This pulse is calculated as supplying fuel to the next cylinder to fuel. It may take more than two fuel events for this to occur.

From block 79 logic flow goes to a decision block 80 wherein there is determined a need for an additional pulse. Using an equation comparing the ratio quantity of the current pulse width to the first pulse width with the calibrated ratio, a decision is made. If the ratio of the current pulse width to the first pulse is greater than the calibrated ratio then logic flow goes to a block 82 wherein there is calculated the dynamic fuel pulse width using the equation: dynpw=(curr_pw−1-st_pw). If the ratio of the current pulse width to the first pulse width is not greater than the calibrated ratio, logic flow goes to a block 81 which is an exit from the logic flow loop. Logic flow from block 82 goes to a block 83 wherein there is scheduled a dynamic fuel pulse on the open intake valve of the current cylinder. That is, this is the second pulse for use in connection with a cylinder in the intake stroke. Note that this cylinder is not the same as the cylinder for which the first pulse width is calculated in block 79. Logic flow from block 83 goes to block 84 wherein the logic flow exits from the flow loop.

Figure 6:
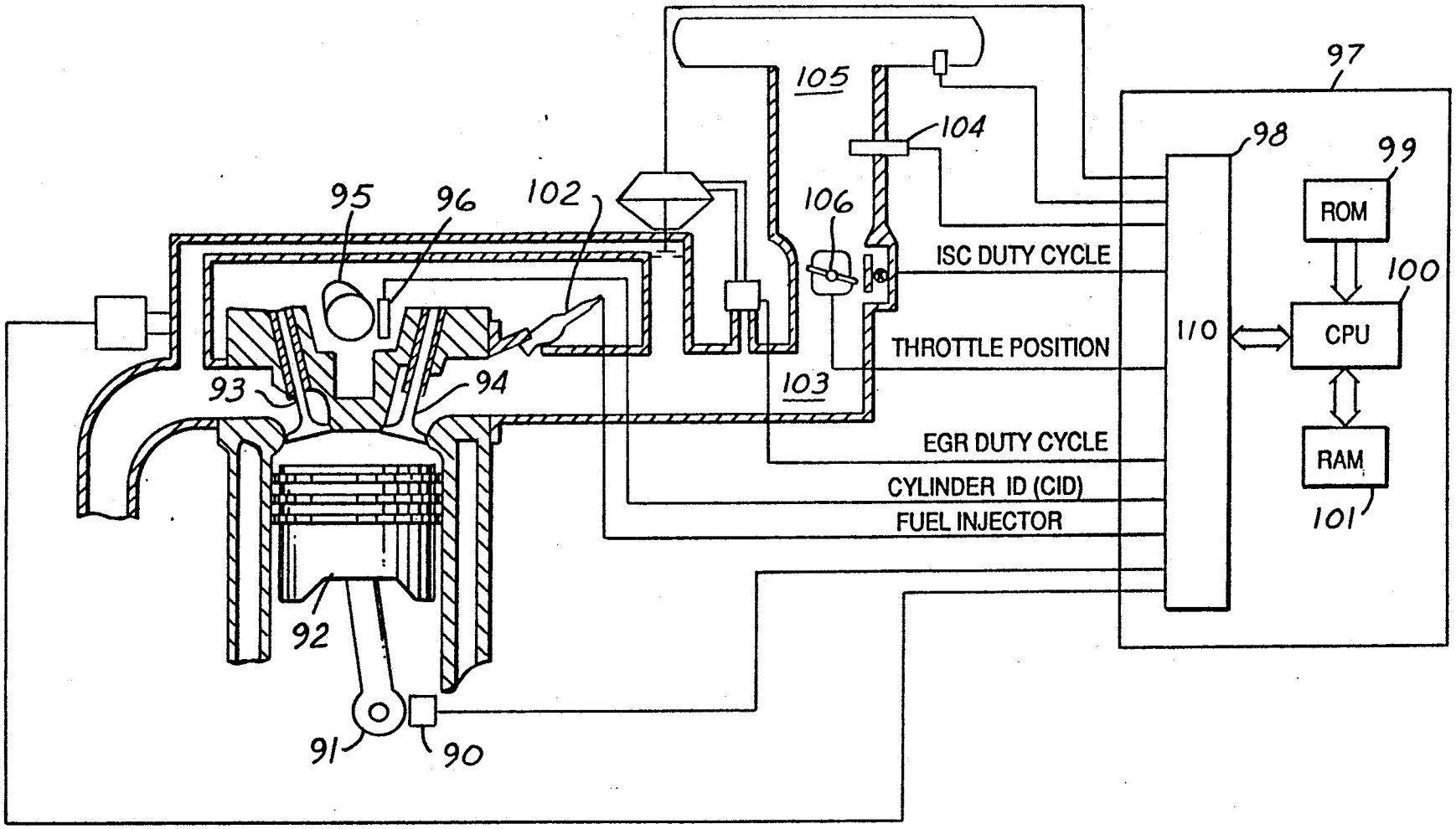
FIG. 6 is a block diagram of an apparatus in accordance with an embodiment of this invention.

Referring to FIG. 6, a block diagram of an apparatus in accordance with an embodiment of this invention includes a PIP sensor 90 coupled to a crankshaft 91 which in turn is coupled to a piston 92. Piston 92 has associated valves 93 for the exhaust and an intake valve 94. A camshaft 95 has an associated camshaft sensor 96 which provides a cylinder identification signal to an electronic engine control 97 which includes an input-/output module 98, a read only memory 99, a central processor unit 100, and a random access memory 101. A fuel injector 102 is coupled to an intake manifold 103 and receives a signal from electronic engine control module 97. A hot-wire air meter 104 is positioned in air intake 105 upstream of a throttle 106. Hot-wire air meter 104 is coupled to electronic engine control module 97.

Figure 7:
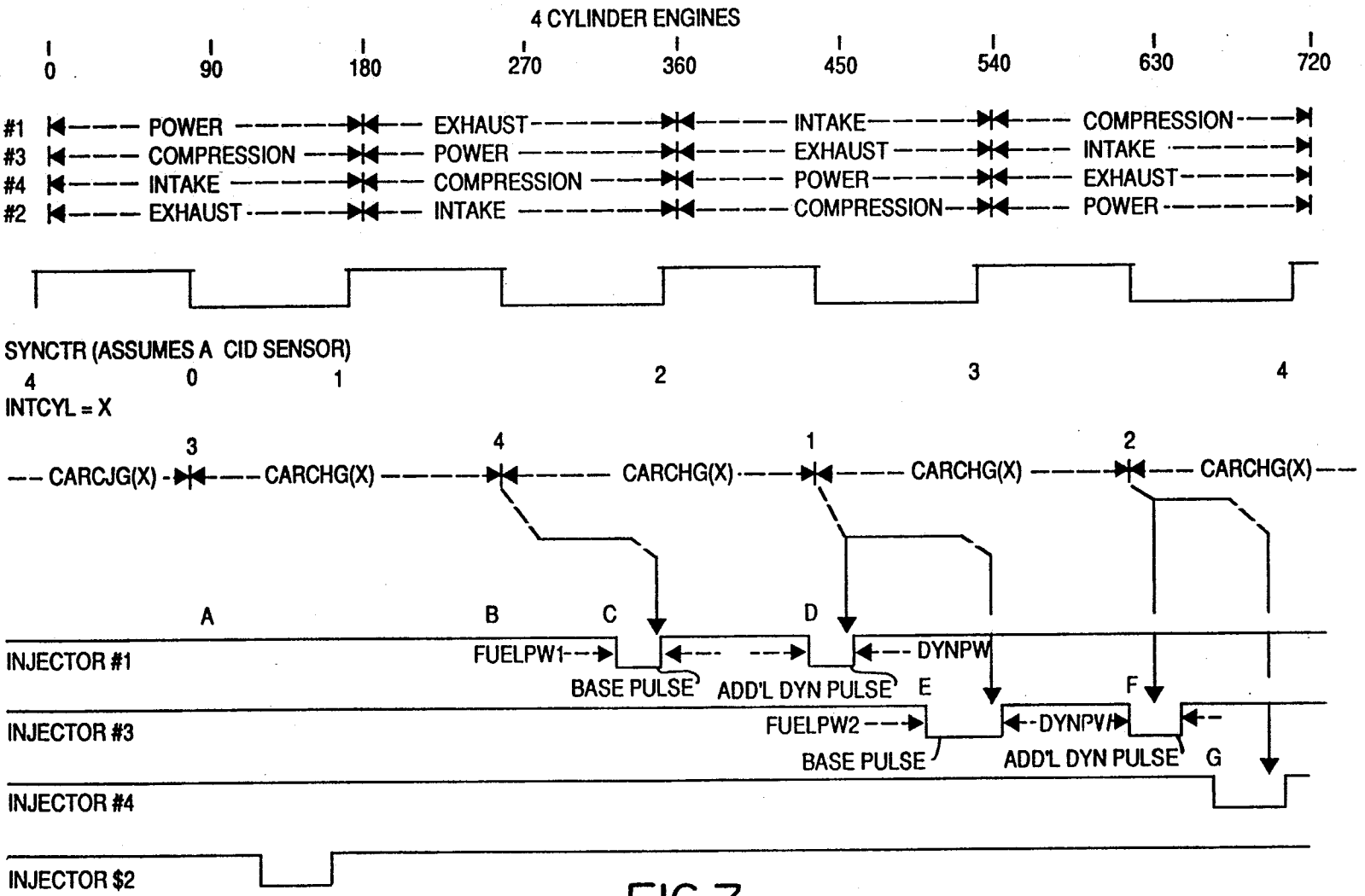
FIG. 7 is a time line sequence for the operation of the four cylinders through the power, exhaust, intake and compression strokes and the action of fuel injectors associated with the cylinders.

Referring to FIG. 7, the cycles for each of the cylinders of a four cylinder engine are shown with respect to degrees of crankshaft rotation. For example, in the top line cylinder 1 goes through a power stroke from 0°-180°, an exhaust stroke from 180°-360°, an intake stroke from 360°-540°, and a compression stroke from 540°-720°. The sequence of the strokes is similar for cylinders 3, 4 and 2 with cylinder 3 starting on a compression stroke, cylinder 4 starting on an intake stroke, and cylinder 2 starting on an exhaust stroke. The lower part of FIG. 7 shows the actuation of injectors 1, 3, 4 and 2 associated with cylinders 1, 3, 4, and 2 respectively. For injectors 1 and 3, a base fuel pulse is shown followed by an additional dynamic fuel pump.

Various modifications and variations will no doubt occur to those skilled in the various arts to which this invention pertains. For example, the relative sizes of the first and second fuel pulses may be varied from that disclosed herein. This and all other variations which basically rely on the teachings through which this disclosure has advanced the art are properly considered within the scope of this invention.

What is claimed:

1. A method of controlling the air/fuel ratio of an internal combustion engine including the steps of:

predicting the air charge to enter the engine in two engine events using the equation $$M_{i+2}^{c} = (2-k)k\,[2\,M_i^{tb} - M_{i-1}^{tb}] + (1-k)^2 M_i^{c}$$

wherein $M^c$=Cylinder air charge $M^{tb}$=Air charge from throttle flow $$k = \left(\frac{1}{ncyl}\right)\left(\frac{Vd}{Vm}\right) \times N \times \eta_v$$

ncyl=Number of cylinders

N=Engine speed (RPM)

Vd=Engine displacement(cu.in.)

Vm=Manifold volume(cu.in.)

$\eta_v$=Volumetric efficiency.

2. A method as recited in claim 1 further comprising the steps of:

determining the amount of fuel to be injected into a cylinder to determine a desired air/fuel ratio;

injecting a first fuel injection pulse;

determining if the first fuel injection pulse is sufficient to meet the desired air/fuel ratio;

injecting a second fuel injection pulse if there is a shortfall of the amount injected by the first fuel injection pulse to achieve the desired air/fuel ratio.

3. A method of controlling the air/fuel ratio of an internal combustion engine including the steps of:

determining air flow into the engine during every induction event;

integrating the air meter reading over the last two samples;

storing the integrated value;

predicting the air charge to enter the engine in two engine events using the equation $$M_{i+2}^{c}=(2=k)k\ ]\ 2\ M_i^{tb}-M_{i-1}^{tb}]+(1-k)\ ^2M_i^{c}$$

wherein $M^c$=Cylinder air charge $M^{tb}$=Air charge from throttle flow $$k=\left(\frac{1}{ncyl}\right)\left(\frac{Vd}{Vm}\right)\times N\times\eta_v$$

ncyl=Number of cylinders

N=Engine speed (RPM)

Vd=Engine displacement(cu.in.)

Vm=Manifold volume(cu.in.)

$\eta_v$=Volumetric efficiency.

determining the amount of fuel to be injected into a cylinder to determine a desired air/fuel ratio;

injecting a first fuel injection pulse;

determining if the first fuel injection pulse is sufficient to meet the desired air/fuel ratio; and injecting a second fuel injection pulse if there is a shortfall of the amount injected by the first fuel injection pulse to achieve the desired air/fuel ratio.

4. A method of controlling the air/fuel ratio an internal combustion engine including the steps of:

reading an air meter indicating airflow into the engine during every induction event;

integrating the air meter reading over the last two samples and adding a leakage factor;

storing the integrated value;

determining a multiplication factor as a function of load for computing a new value of an estimated cylinder air charge;

predicting air charge two induction events into the future;

computing the equivalent fuel charge at the current desired air/fuel ratio;

computing the injector pulse width corresponding to the desired fuel charge;

scheduling the pulse width for the fuel pulse to be applied to the next cylinder to fuel;

determining the need for an additional fuel pulse;

if additional fuel is needed, calculating a dynamic fuel pulse width for a second fuel pulse; and scheduling a second fuel pulse to occur on an open intake valve.

5. A method of controlling the air/fuel ratio of an internal combustion engine as recited in claim 4 wherein the step of predicting air charge two induction events into the future is in accordance with the formula:

$$cylarc=k*(2-k)*(2*archi-archp))+(1-k)2*archfg,$$

wherein cylarc=the engine air charge archi=the air charge mass indicated per intake stroke corrected for back flow and leakage archp =air charge for previous event archfg=a predicted cylinder air charge from the manifold filling model.

6. A method of controlling the air/fuel ratio of an internal combustion engine as recited in claim 4 wherein the step of computing the equivalent fuel charge at the current desired air/fuel ratio is in accordance with the formula:

$$fuechg=\frac{cylarc}{desaf}$$

wherein fuechg is fuel charge cylarc is air charge desaf is desired air/fuel ratio.

7. A method of controlling the air/fuel ratio of an internal combustion engine as recited in claim 6 wherein the step of determining the need for an additional fuel pulse is in accordance with the formula:

$$\frac{curr_pw}{1^{st}_pw}>pw\ cal$$

wherein curr_pw is current fuel injection pulse width

1st_pw is pulse width of the first fuel injection pulse pw cal is the calibrated fuel injection pulse width.

* * * * *